United States Patent [19]

Schwartz

[11] Patent Number: 4,667,188

[45] Date of Patent: May 19, 1987

[54] PORTABLE ALARM

[75] Inventor: Frederick W. Schwartz, Providence, R.I.

[73] Assignee: Cable Electric Products, Inc., Providence, R.I.

[21] Appl. No.: 848,075

[22] Filed: Apr. 4, 1986

Related U.S. Application Data

[63] Continuation of Ser. No. 727,161, Apr. 25, 1985, abandoned, which is a continuation of Ser. No. 404,112, Aug. 2, 1982, abandoned.

[51] Int. Cl.[4] ..... G08B 21/00; G08B 13/08

[52] U.S. Cl. ..... 340/689; 200/61.52; 340/546; 340/573; 340/574

[58] Field of Search ..... 340/689, 573, 574, 546, 340/321; 200/61.52; 116/77; 224/252, 269, 163, 904; 24/543, 192, 163 K

[56] References Cited

U.S. PATENT DOCUMENTS

| | | | |
|---|---|---|---|
| 3,315,166 | 4/1967 | Crump | 340/321 |
| 3,614,763 | 10/1971 | Yannuzzi | 340/689 |
| 3,740,648 | 6/1973 | Grotjahn | 340/573 X |
| 3,878,539 | 4/1975 | Gooding | 340/546 |
| 4,100,653 | 7/1978 | Sensabaugh | 224/252 X |
| 4,149,156 | 4/1979 | Blasucci | 340/546 X |
| 4,190,955 | 3/1980 | Rushforth | 224/904 X |
| 4,264,899 | 4/1981 | Menzies et al. | 340/689 X |
| 4,438,428 | 3/1984 | Ober et al. | 340/546 X |

*Primary Examiner*—James L. Rowland
*Assistant Examiner*—Thomas J. Mullen, Jr.
*Attorney, Agent, or Firm*—Paul J. Sutton

[57] ABSTRACT

An apparatus is described which can be used by an individual for a multiplicity of purposes. The individual carrying the alarm of this invention can use the device to signal for help during a mugging. The device can also be used as a general call for help.

In particular, a position sensitive switch allows the device to be used to sound an alarm when an individual wearing the device falls. Additionally, the device can be placed against a door so that it can signal a burglary.

11 Claims, 8 Drawing Figures

FIG. 6
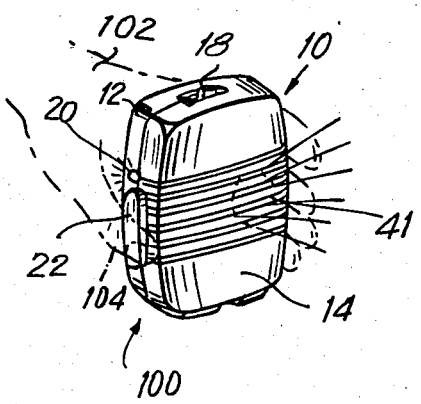
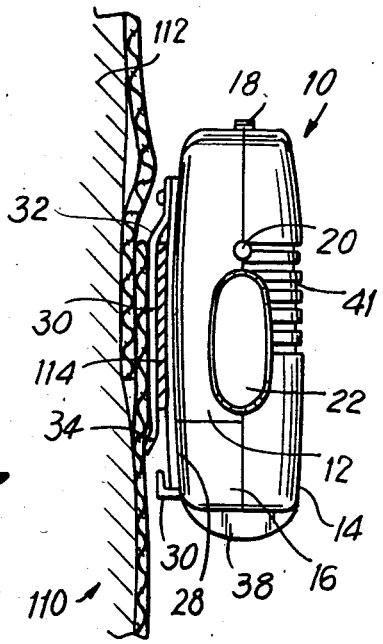
FIG. 7
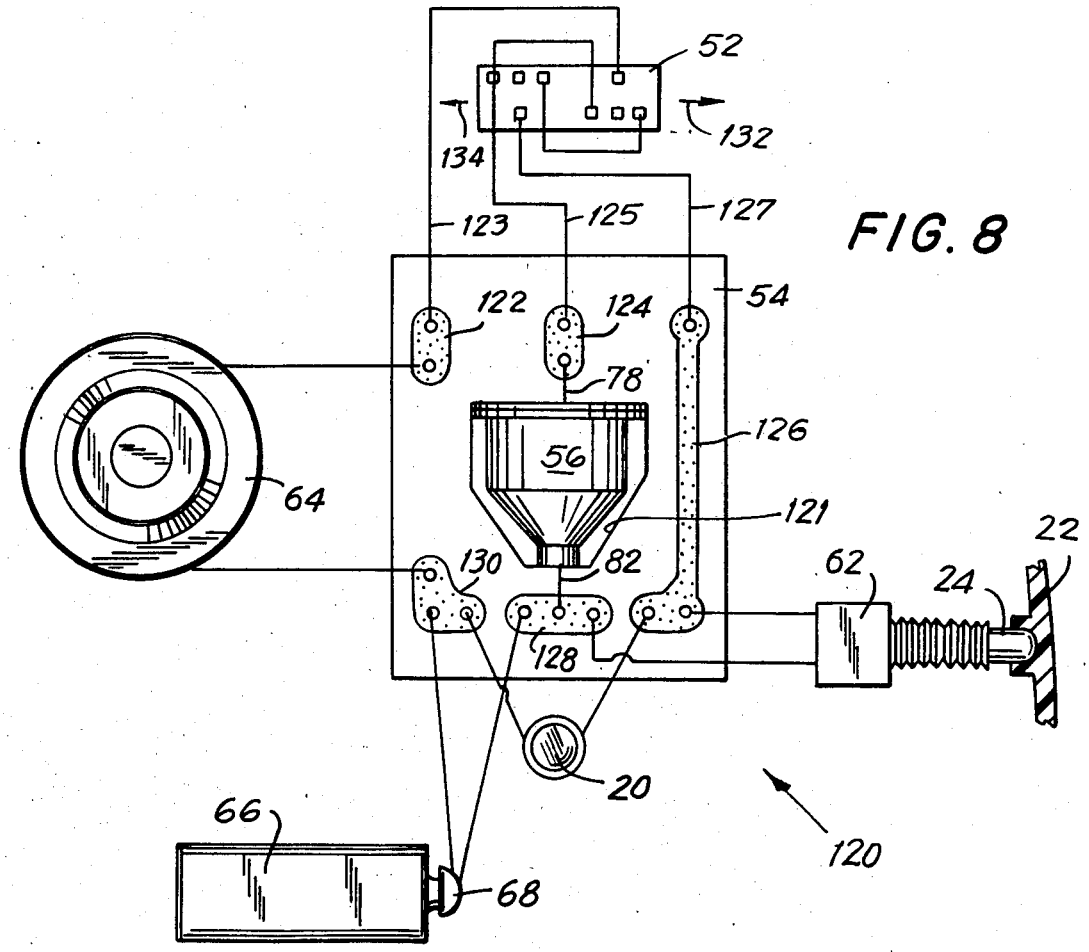
FIG. 8

PORTABLE ALARM

CROSS-REFERENCE TO RELATED APPLICATIONS

This application is a continuation of patent application Ser. No. 727,161, filed Apr. 25, 1985, now abandoned, which was a continuation of patent application Ser. No. 404,112, filed Aug. 2, 1982, now abandoned.

BACKGROUND OF THE INVENTION

1. Field of the Invention

This invention relates to portable alarms in general and specifically to an alarm which contains a position sensitive element.

2. Prior Art

Portable alarms are becomming increasingly common and similar in function and design. The alarm of the present invention is different from those commonly available since it contains a position sensitive element.

The portable alarms generally available are primarily designed to be detachably affixed to a window or door. The alarms then signal an unauthorized entry through the door or window. The alarm of the present invention is portable and intended to be carried on the person of the user. In addition to the foregoing stated purpose the alarm can be used when hand held as well as when placed against a door.

Previous attempts to construct a position sensitive sensor have employed a mechanical pendulum which would complete an electrical circuit if the pendulum moved. The electrical circuit would then energize a sounding device. The alarm of the present invention utilizes a compact sensor which employs a globule of mercury. The sensor known as a tilt switch can be constructed so that an 8° deviation from the vertical will sound the alarm or a 45° deviation from the vertical will sound the alarm; the sensitivity of the tilt switch depends upon the needs of the user.

SUMMARY OF THE INVENTION

An object of the present invention is to provide a multipurpose alarm;

Another object of the present invention is to provide for mounting of the alarm on a user's person;

Yet another object of the present invention is to permit the alarms use in conjunction with a door;

Still another object of the present invention is to detect deviations from a vertical position;

A further object of the present invention is to provide for a light source which allows night time use;

Yet a further object of the present invention is to provide a function switch for the selection of the operating mode.

My invention will be made more clearly understood from the following description or specific embodiments of the invention, together with the accompanying drawings.

BRIEF DESCRIPTION OF THE DRAWINGS

FIG. 6 illustrates the portable alarm of the present invention as a hand held device;

FIG. 7 illustrates the portable alarm of the present invention as a belt worn device;

FIG. 8 shows a pictorial illustation of the portable alarm wiring.

DESCRIPTION OF THE PREFERRED EMBODIMENT

The portable alarm of the present invention is capable of performing several functions. It is capable of acting as a door alarm for the traveler. Another use is that of a panic alarm for the person walking in the street. Wearing the portable alarm on a belt the person has some way of sounding an alarm if he is mugged. The invalid can also make use of the alarm of the present invention to call for help or to signal when the invalid has fallen.

Figure 1:
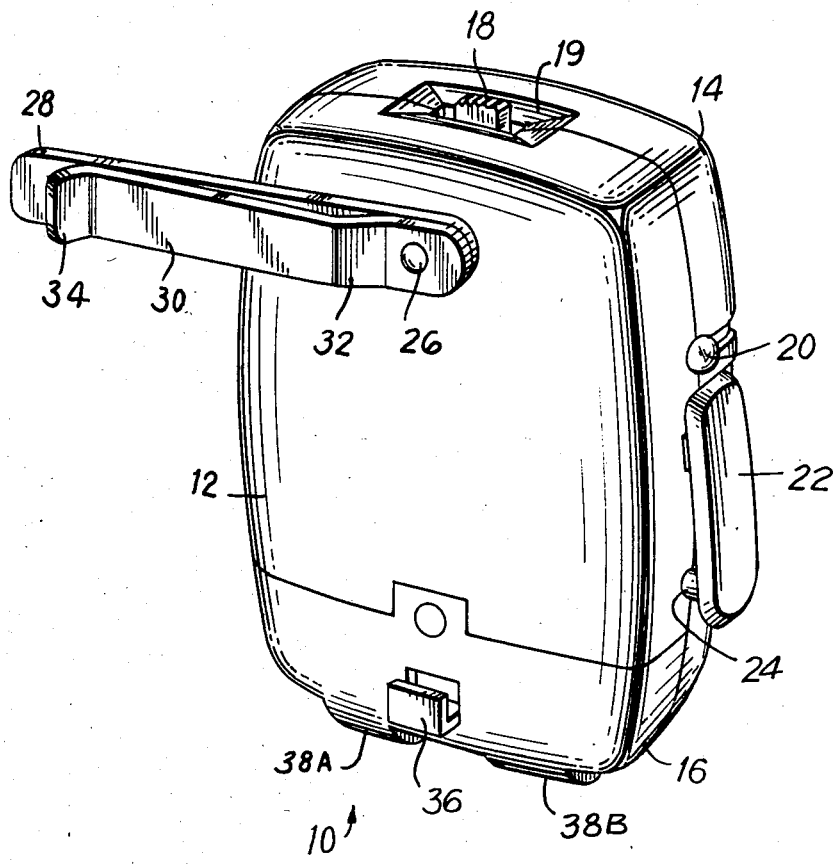
FIG. 1 is a perspective view of the portable alarm described herein.

FIG. 1 shows a portable alarm 10 of the present invention. The portable alarm 10 is comprised of a partial housing portion 12 fitted to a full housing portion 14. At the bottom of the portable alarm 10 is seen a battery cover 16 having a nesting clip 36 molded thereto. The foregoing portions of the housing may be fabricated from plastic or metal depending upon the application and environment of the alarm 10.

At the top of the alarm 10 is seen a switch opening 19 which allows a function switch handle 18 to be operated. The right side of portable 10 shows a light emitting diode 20 and directly below is found an actuating lever 22.

The actuating lever 22 makes contact with a panic switch plunger 24 protruding from the portable alarm 10.

The front face of the portable alarm 10 is seen to have a retaining rivet 26 attached to the upper part of the partial housing portion 12. the rivet 26 is used to attach an inner clip portion 28 and an outer clip portion 30 to the portable alarm 10. Whereas the inner clip portion 28 is seen to be formed of flat material having rounded ends as shown the outer clip portion 30 is somewhat more complex. The outer clip portion 30 is formed with a first bend 32 proximate to the rivet 26 position and a second bend 34 remote from the rivet 26 position. FIG. 1 also shows a nesting bracket 36 into which the inner clip portion 28 fits. A pair of protrusions 38 are molded onto the portable alarm 10 housing. The protrusions 38 are shown as being rounded, the shape of the protrusions may be varied as desired.

Figure 2:
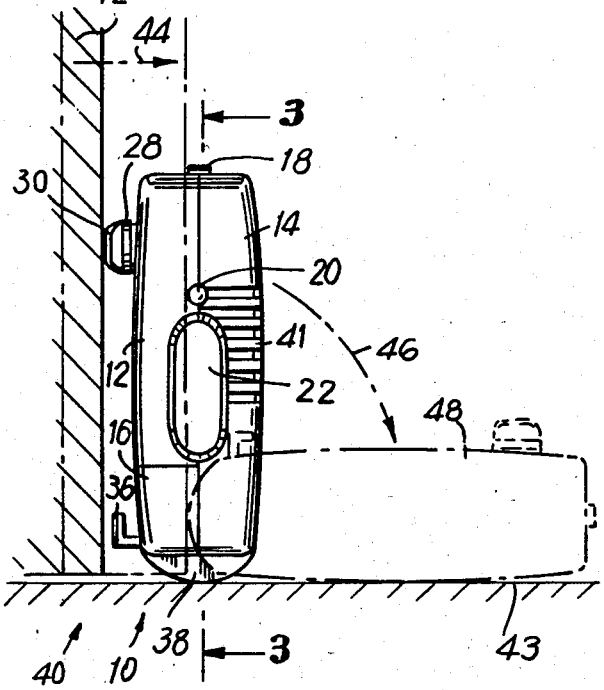
FIG. 2 is an elevational view of the present invention as a door alarm.

FIG. 2 shows the portable alarm 10 in a door alarm application 40. Shown here are the partial housing portion 12, the full housing portion 14 and the battery cover 16. Seen in this view are a series of openings 41 molded into the full housing portion 14. Other items shown here are the function switch handle 18, the light emitting diode 20 and the actuating lever 22. Affixed to the partial housing portion 12 are the inner clip portion 28 and the outer clip portion 30. Attached to the battery cover 16 is the nesting bracket 36 which is shown as "ell" shaped.

The portable alarm 10 is shown resting on the protrusions 38 which are in contact with a floor 43. The portable alarm 10 therefore rests on the floor 43 and is slightly tilted toward a door 42 such that the door 42 prevents the portable alarm 10 from falling. When the door 42 is caused to move in the direction of an arrow 44 the portable alarm 10 is caused to become unstable and fall in the direction of an arrow 46. A fallen position 48 then causes the sounding of the alarm.

Figure 3:
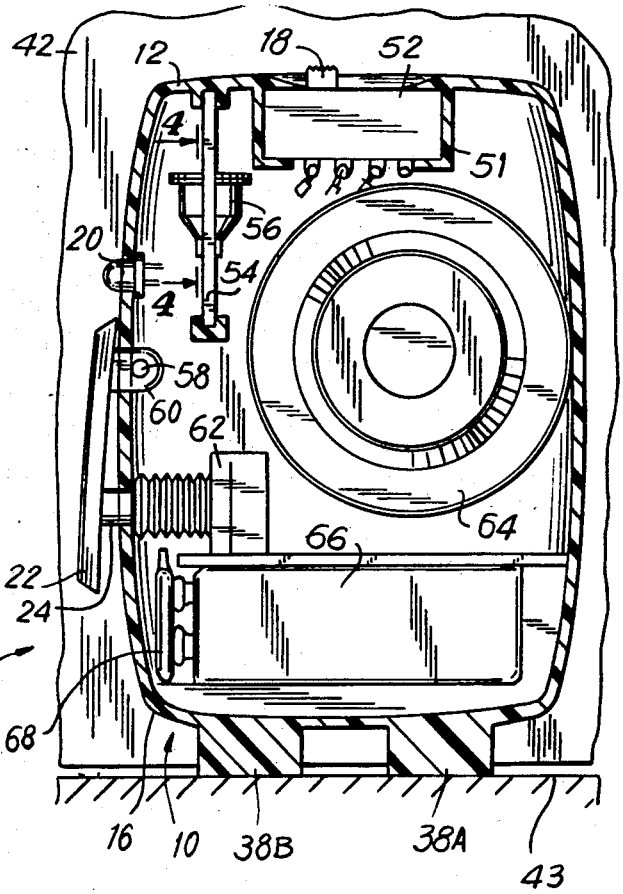
FIG. 3 is a section taken through 3—3 of FIG. 2.

FIG. 3 is a section 50 taken through 3—3 of FIG. 2. The section 50 shows in greater detail the placement of components within the portable alarm 10. Section 50 comprises the partial housing 12 and the battery cover 16. Mounted within a cellular structure 51 is a switch body 52 having the function switch handle 18 attached. To the left of the switch body 52 is demountably located a printed circuit board 54 having affixed to it a tilt switch 56. Affixed onto the partial housing 12 is the light emitting diode 20 and the actuating lever 22. The actuating lever 22 is seen to have a support 60 projecting therefrom and is pivotaly attached to the partial housing 12 by a pivot pin 58. Affixed to the actuating lever 22 is the panic switch plunger 24. The panic switch plunger 24 is seen to be part of a panic switch 62 which is fastened to the partial housing 12. Within the partial housing 12 is a horn 64 for use in sounding the alarm. The horn 64 is capable of generating a 55 DB sound level. Further shown is a battery 65 and a battery terminal 68. Attached to the battery cover 16 are the protrusions 38, seen in contact with the floor 43. Behind the portable alarm 10 is shown a fragment of the door 42.

Figure 4:
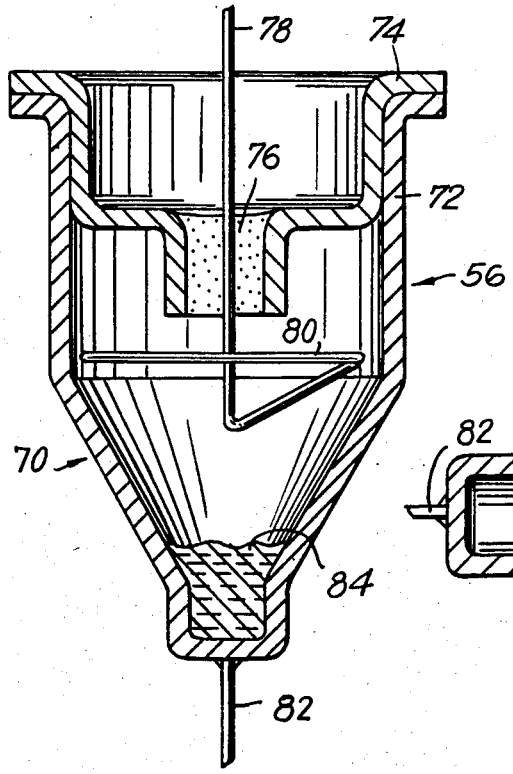
FIG. 4 is a section taken through 4—4 of FIG. 3.

FIG. 4 shows a section 70 taken through 4—4 of FIG. 3. Herein the tilt switch 56 has been opened to expose the internal features. The tilt switch 56 is seen to be comprised of a metal casing 72 welded or other wise attached to a metal cap 74. The metal cap 74 has an insulator 76 filling the central opening of the metal cap 74. Secured within the insulator 76 is an inner electrode connection 78. The inner electrode connection 78 has a part of it a ring portion 89 seen on end in FIG. 4. Attached to the metal casing 72 is an outer electrode connection 82 and contained within the metal casing 72 is a mercury pool 84.

Figure 5:
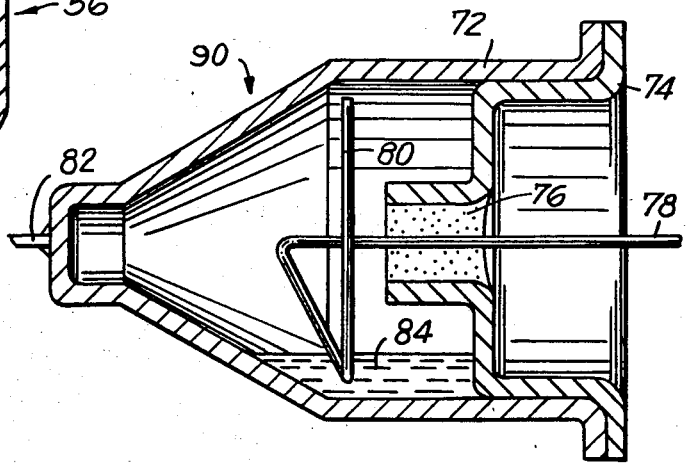
FIG. 5 illustrates the operation of the tilt switch.

FIG. 5 shows the tilt switch 56 on its side 90. The construction of the tilt switch 56 is the same as in FIG. 4. What is to be noted in this figure is that the mercury pool 84 has enveloped part of the ring portion 80. Since mercury is a fluid and is conductive the present position of pool 84 allows electrical conductivity between outer electrode 82 and inner electrode 78.

FIG. 6 shows a hand held alarm 100 wherein the portable alarm 10 is shown being held in a users hand 102. A thumb 104 is causing the actuating lever 22 to be depressed. With the function switch handle 18 in the panic alarm position the portable alarm 10 is sounding an alarm. The alarm is emitted by the horn 64 behind the series of openings 41 and the light emitting diode 20 is lighted.

FIG. 7 illustrates the belt worn alarm 110 where there is shown a partial cross section of a users clothing 112 and a users belt 114. Attached to the users belt 114 by the outer clip portion 30 is the portable alarm 10. FIG. 7 also shows the function switch handle 18, the light emitting diode 20 and the actuating lever 22.

FIG. 8 pictures a pictorial illustration 120 the portable alarm 10 wiring. Seen here is the printed circuit board 54 having a central cutout 121 for containing the tilt switch 56. The inner electrode connection 78 is attached to a second land 124. The various lands are the copper which has remained on the board 54 after etching. The outer electrode connection 82 is connected to a fourth land 128 which is part of the printed circuit board 54.

The switch 52 has three connections to the printed circuit board 54. A common switch connection 123 is attached to a first land 122 on the circuit board 54. A first switch connection 125 is attached to the second land 124 and a second switch connection 127 is attached to a third land 126. The switch 52 can be moved to connect different portions of the circuit by sliding switch 52 in a first position 132 or a second position 134. Switch 52 may also have a third disconnect, or center-off position. The horn 64 has one connection made to the first land 122 and the other connection made to a fifth land 130 on the printed circuit board 54.

One terminal of the battery 66 is attached to the fifth land 130 and the other terminal of the battery 66 is connected to the fourth land 128. The light emitting diode 20 is shown to be connected between the fifth land 130 and the third land 126. The panic switch 62 is seen to be connected between the third land 126 and the fourth land 128.

Operation of the herein described invention will be better understood by reading the foregoing figures in conjunction with the following description.

The portable alarm 10 is capable of operation in two modes. The first mode is where pressure on the actuating lever 22 will cause the horn 64 to sound an alarm. Operating the actuating lever 22 also causes the light emitting diode 22 to be energized. The operation of the portable alarm 10 in the first mode is obtained by placing the function switch body 52 shown in FIG. 8 in the first position 132. With the switch 52 in the first position 132 the electrical circuit is completed when the actuating lever 22 is depressed, best seen in FIG. 6. As long as the actuating lever is depressed the plunger 24 closes the contact within switch body 62 and completes the electrical circuit between the third land 126 and the fourth land 128. With the function switch 52 in the first position 132 the third land 126 is electrically connected to the first land 122. Therefore depressing lever 22 connects the battery 66 to the horn 64 and also energizes the light emitting diode 20. The light emitting diode 20 makes the portable alarm 10 visible at night. Therefore the source of the alarm can more easily be located. The fact that the actuating lever 22 can be used to turn the horn 64 on and off provides for versatility in the use of portable alarm 10.

The second mode of operations for the portable alarm is obtained with the second position 134 of the function switch 52. Here, function switch 52 connects the second land 124 to the first land 122 and permits the tilt switch 56 to connect or disconnect the horn 64 to and from the battery 66. In this second mode the light emmitting diode 20 and the panic switch 62 are inoperative.

FIG. 4 shows that if the tilt switch 56 is arranged so that the inner electrode connection 78 is vertically above the outer electrode connection 82 the pool of mercury 84 is furthest away from the ring portion 80. FIG. 5 shows the condition that exists when inner connection 78 and outer connection 82 are both horizontal. In the foregoing situation mercury pool 84 causes the ring portion 80 to contact the metal casing 72. The tilt switch 56 can be designed so that the sensitivity of the switch 56 may be varied.

FIG. 4 shows the tilt switch 56 in the vertical position and by varying the design parameters the tilt switch can be designed to be activated from an 8° tilt to a 50° tilt from the vertical. Primarily the sensitivity is controlled by varying the quantity of mercury placed in the mercury pool 84. The present portable alarm 10 utilizes the tilt switch 56 having a 50° tilt angle in order to activate the horn 64.

any portion of said lever, will result in said electrical closure.

10. The apparatus of claim 9 wherein said housing includes a printed circuit board and said first sensor is mounted in said first printed circuit board which is supported by said housing.

11. The apparatus of claim 10 wherein said housing is provided with a series of openings enabling the sound from said horn to be audible outside said housing.

* * * * *

The portable alarm 10 operating in the second mode can have several applications. One application as a door burglar alarm is that shown in FIG. 2 of the accompanying drawings. FIG. 2 shows that the outer and inner clip portions 28 and 30 are turned at right angles to the major axis of the portable alarm 10. If the portable alarm is placed with the protrusions 38 against the floor and leaned against the door 42 the tilt switch 56 is kept substantially vertical. When someone opens the door 42 the portable alarm 10 is caused to fall in the arrows 46 direction.

As soon as the portable alarm 10 falls so as to reach an angle of 50° the horn 64 is sounded and the burglar is routed.

FIG. 7 shows the portable alarm 10 used as a stability alarm. Herein is shown that the inner clip portion 28 is locked into the nesting bracket 36. The belt 114 is captured between the inner clip portion 28 and the outer clip portion 30. The outer clip portion 30 has the first bend 32 to provide clearance for the belt 114 and the second bend 34 which facilitates the placement of the belt 114 between the inner clip portion 28 and the outer clip portion 30. With the portable alarm 10 in the second position 134 any instability on the part of the wearer of the belt 114 will sound an alarm by actuating horn 64.

The wearer of the portable alarm 10 may be a victim of a mugger in which case if he has fallen the probability is that the portable alarm 10 will sound. The wearer may be a person prone to falling because of an infirmity in which case the portable alarm 10 will warn others of his fall. The portable alarm 10 may also be hand held by a patient and warn others if he falls asleep and therefore relaxes his hand. Ther are other applications which have not been foreseen for which the portable alarm 10 of the present invention is applicable.

While the present invention has been discussed in connection with the preferred embodiment thereof, it should be understood that there may be other embodiments which may fall within the spirit and scope of the invention as defined by the following claims.

What is claimed is:

1. A portable alarm apparatus, comprising:

a housing having power supply means, a protrusion affixed to a portion of said housing;

a clip adjustably affixed to said housing;

a function switch affixed to said housing operatively connected to said power supply;

sensing means affixed to said housing, operatively connected to said function switch, said sensing means being responsive to conditions external to said housing, and said sensing means including a first sensor comprising a frusto-conical well, mounted vertically and containing a pool of liquid mercury in a bottom portion thereof, said well including an electrical contact element suspended internally above said mercury liquid, said bottom portion being electrically conductive, and said contact element including a portion formed in a ring, so that electrical contact is made between said ring and said bottom portion when said housing is tilted from the vertical in any direction on a substantially 360 degree radius;

indicating means affixed to said housing, operatively connected to said function switch for responding to said sensing means whereby a person in the vicinity of said portable alarm is alerted to said responsiveness of said sensing means, and said indicating means including a first indicator comprising means for generating an audible alarm for emination from said housing.

2. The apparatus of claim 1, further comprising:

said well having such form so that said electrical contact between said ring and said bottom portion is made at any of predetermined tilt angles within the range of approximately 8 degrees tilt to 50 degrees by including a measured amount of mercury in the bottom portion, and said protrusion having a rounded and substantially rigid form so as to produce maximum instability when said protrusion is in contact with a flat surface.

3. The apparatus of claims 1 or 2 further comprising:

said sensing means further including a second sensor comprising a normally open electrical switch, having a pressure receiving portion located on said housing for manual operation so that electrical closure is made when the pressure receiving portion is pressed toward the housing.

4. The apparatus of claim 3 further comprising:

said indicating means including a second indicator comprising for generating a visible alarm for elimination from said housing, and said function switch including a first position and a second position, whereby in said first position, said first sensor and said first indicator are electrically connected with said power supply so that said first indicator is activated when said housing is tilted, and inactive when said housing is vertical, and in said second function switch position, said second sensor, said first indicator and said second indicator are electrically connected with said power supply so that said so-connected indicators are activated when said pressure receiving portion is pressed toward the housing, and are inactive when not pressed toward the housing.

5. The apparatus of claim 4, wherein said clip comprises a nesting bracket, an inner clip portion and an outer clip portion, pivotably mounted at one end of said housing, and having a first and a second adjustable position; wherein in said first position said inner portion fits into said nesting bracket which is located so that said apparatus may be worn vertically without rotation on a belt, and in said second position said clip is approximately 90 degrees to the first position, so that said clip provides spacing by its thickness between said housing and a vertical surface when said apparatus is leaned against said vertical surface.

6. The apparatus of claim 5 wherein said first indicator comprises a horn for sounding the audible alarm.

7. The apparatus of claim 6 wherein said second indicator further comprises a light emitting diode so as to provide nighttime visibility of said portable alarm apparatus.

8. The apparatus of claim 7 wherein said function switch includes a third, off position.

9. The apparatus of claim 8 further comprising said second sensor's pressure receiving portion includes a plunger, said plunger is operatively connected to a lever pivotally attached to said housing so that force applied by a user's hand, in the direction of the housing, to